US005433495A

United States Patent [19]

Uffner

[11] Patent Number: 5,433,495

[45] Date of Patent: Jul. 18, 1995

[54] TWO-WAY DOOR LATCH

[76] Inventor: Gary H. Uffner, 500 E. 83rd St., New York, N.Y. 10028

[21] Appl. No.: 35,185

[22] Filed: Mar. 22, 1993

[51] Int. Cl.[6] ..... E05C 1/12

[52] U.S. Cl. ..... 292/169; 292/169.14; 292/356; 292/359

[58] Field of Search ..... 292/169.12, 169.14, 292/169, 356, 357, 359, DIG. 61, 1, 336.3; 267/150

[56] References Cited

U.S. PATENT DOCUMENTS

| | | | |
|---|---|---|---|
| 2,077,728 | 4/1937 | Whitney | 292/169 X |
| 2,729,485 | 1/1956 | Schlage | 292/356 X |
| 4,062,579 | 12/1977 | Potter et al. | 292/348 |

FOREIGN PATENT DOCUMENTS

| | | | |
|---|---|---|---|
| 1111402 | 2/1956 | France | 292/34 |
| 2516254 | 10/1976 | Germany | 292/336.3 |
| 2910757 | 10/1980 | Germany | 292/336.3 |
| 374 | of 1872 | United Kingdom | 292/336.3 |
| 1039013 | 8/1966 | United Kingdom | 292/336.3 |
| 494871 | 5/1977 | United Kingdom | 292/169.12 |

*Primary Examiner*—Rodney M. Lindsey
*Attorney, Agent, or Firm*—Michael Ebert

[57] ABSTRACT

A two-way door latch that is swingable relative to a door jamb, the door having an opening adjacent its edge whose opposing ends are covered by a pair of escutcheons. Rotatably mounted on each escutcheon is a knob having a short shaft that extends into the escutcheon and terminates in a cam, the knobs being rotable about a common axis. One of the cams is spring-biased and so shaped as to maintain the related knob at a rest position, whereby when the knob is turned in either direction to unlatch the door, when released the knob will be returned to its rest position. The cams are bridged by a pair of pins that are offset with respect to the common axis, and when a knob is turned, the pins then travel in a circle concentric with the axis. Received within a bore in the edge of the door is a latch bolt assembly having a spring-biased bolt that normally projects into a strike plate mounted over a cavity in the door jamb and a pair of ramp elements operatively coupled to the bolt and engaged by the pins, whereby when an escutcheon knob is turned in either direction, the ramp elements are advanced to retract the bolt and unlatch the door.

4 Claims, 6 Drawing Sheets

TWO-WAY DOOR LATCH

BACKGROUND OF INVENTION

1. Field of Invention

This invention relates generally to a two-way door latch whose knobs may be turned either clockwise or counterclockwise for retracting a latch bolt to open the door, and more particularly to a door latch of this type in which the knobs are normally maintained at a rest position, and when the latch is put in a privacy mode so that the knobs cannot be rotated, this mode is visually indicated.

2. Status of Prior Art

In a conventional door latch, the hinged door is provided adjacent its edge with an opening whose opposing ends are covered by escutcheons. Mounted on these escutcheons are two knobs which rotate about a common axis and are operatively coupled to a latch bolt assembly received in a bore in the edge of the door. The latch bolt is spring-biased so that it normally projects into a strike plate mounted over a cavity in the door jamb, thereby locking the door. When either knob is turned, the latch bolt is retracted from the strike plate and the door may then be swung open.

As used herein, the term knob refers to a rounded protuberance or a handle having an arm extension.

In the door latch disclosed in the Morgan U.S. Pat. No. 3,580,622, a single screw coaxial with the knob axis interconnects the escutcheons on opposite sides of the door to secure the escutcheons and the latch bolt assembly interlocked to the escutcheons in assembled relation. One of the knobs in the door latch may be shifted axially to engage the corresponding escutcheon so that the knob cannot then be rotated, thereby providing a privacy lock. In the Morgan latching arrangement, the knobs can only be turned in one direction-clockwise or counterclockwise-to unlatch the door.

In the two-way door latch arrangement disclosed in the Ramsey U.S. Pat. No. 3,792,886, the knobs may be turned either clockwise or counterclockwise for retracting the latch bolt. One of the knobs engages the related escutcheon when the knob is pushed towards the door to prevent rotation and provide a privacy lock. The escutcheon used in a privacy lock on the locking side of the door, say, inside a bathroom or bedroom, is referred to as the "locking" escutcheon. The escutcheon on the opposite side of the door is referred to as the "free" escutcheon. A pair of pins extend between the knobs and engage ramp elements in the latch bolt assembly which act to retract the bolt. A similar door latch is shown in the Ramsey U.S. Pat. No. 3,826,527.

The Ramsey U.S. Pat. No. 3,792,887 discloses a cylindrical patent bolt assembly insertable in a door edge so that it is in operative relation to a knob-operated door latch, the inner end of the spring-biased latch bolt having a pair of parallel legs each terminating in a ramp. When these elements are engaged by the operating mechanism of the door latch, the bolt is then retracted from the strike plate mounted in the door jamb.

The present invention is usable with any commercially available latch bolt assembly in which a spring-biased bolt cooperates with a pair of parallel legs, each terminating in a ramp, the ramp elements being engaged by a pair of pins which are offset with respect to the axis of rotation of the knob, such that when the knob is rotated, the pins travel in a circle concentric with this axis to cause the ramp elements engaged thereby to retract the latching bolt.

SUMMARY OF INVENTION

The main object of this invention is to provide a two-way door latch of simple mechanical design, which may be manufactured at relatively low cost, and which operates efficiently and reliably, the door latch having a latching mode in which the latched door may be unlatched and opened by turning a knob on either side of the door in either direction, and a privacy mode in which neither knob can be turned.

More particularly, an object of this invention is to provide a door latch of the above type in which the knobs are normally maintained at a rest or neutral position, which in the case of a rounded knob is at zero degrees, and in the case of a handle-type knob places the handle in a horizontal position, so that when a knob is turned in either direction to unlatch the door, the knob, when released, will be returned to its rest position.

Also an object of the invention is to provide a door latch whose knobs cannot be rotated when the latch is put in its privacy mode, this being effected by pushing in the knob mounted on the locking escutcheon.

A significant feature of the invention is that the latch cannot be put in its privacy mode unless the knob for this purpose is first turned a few degrees before being pushed in, thereby avoiding an accidental operation, such as when the knob hits a wall when the door is swung open.

Still another object of the invention is to provide a door latch in which the escutcheons on opposite sides of the door are held in place by a single rod which passes through the opening in the door and intercouples the escutcheons, the rod also functioning as a visual indicator that the door latch is in its privacy mode.

Briefly stated, these objects are attained in a two-way door latch that is swingable relative to a door jamb, the door having an opening adjacent its edge whose opposing ends are covered by a pair of escutcheons. Rotatably mounted on each escutcheon is a knob having a short shaft that extends into the escutcheon and terminates in a cam, the knobs being rotable about a common axis. One of the cams is spring-biased and so shaped as to maintain the related knob at a rest position, whereby when the knob is turned in either direction to unlatch the door, when released the knob will be returned to its rest position. The cams are bridged by a pair of pins that are offset with respect to the common axis, and when a knob is turned, the pins then travel in a circle concentric with the axis. Received within a bore in the edge of the door is a latch bolt assembly having a spring-biased bolt that normally projects into a strike plate mounted over a cavity in the door jamb and a pair of ramp elements operatively coupled to the bolt and engaged by the pins, whereby when an escutcheon know is turned in either direction, the ramp elements are advanced to retract the bolt and unlatch the door.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
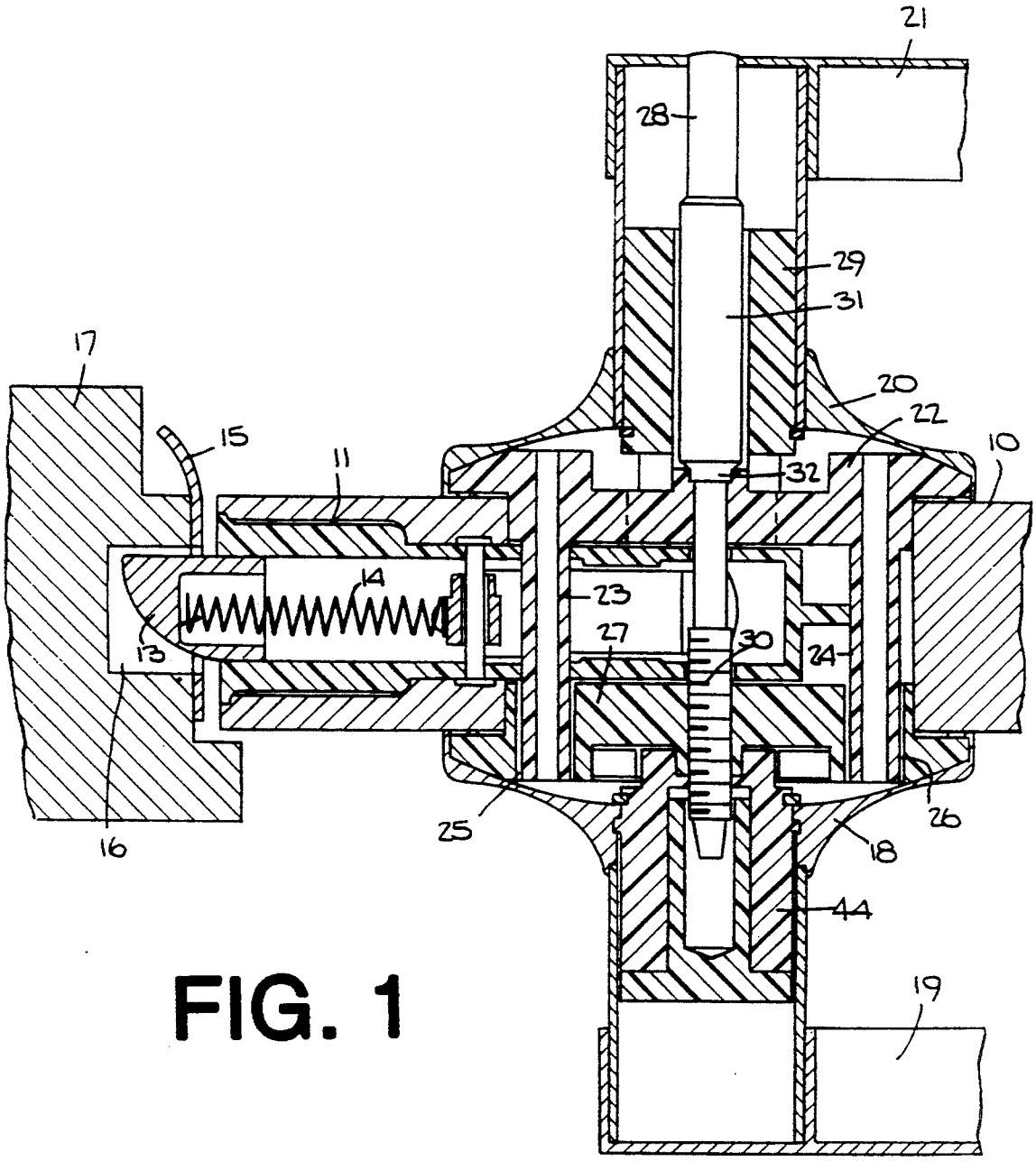
FIG. 1 is a perspective view of a door latch in accordance with the invention as it appears in its latching mode.
Figure 2:
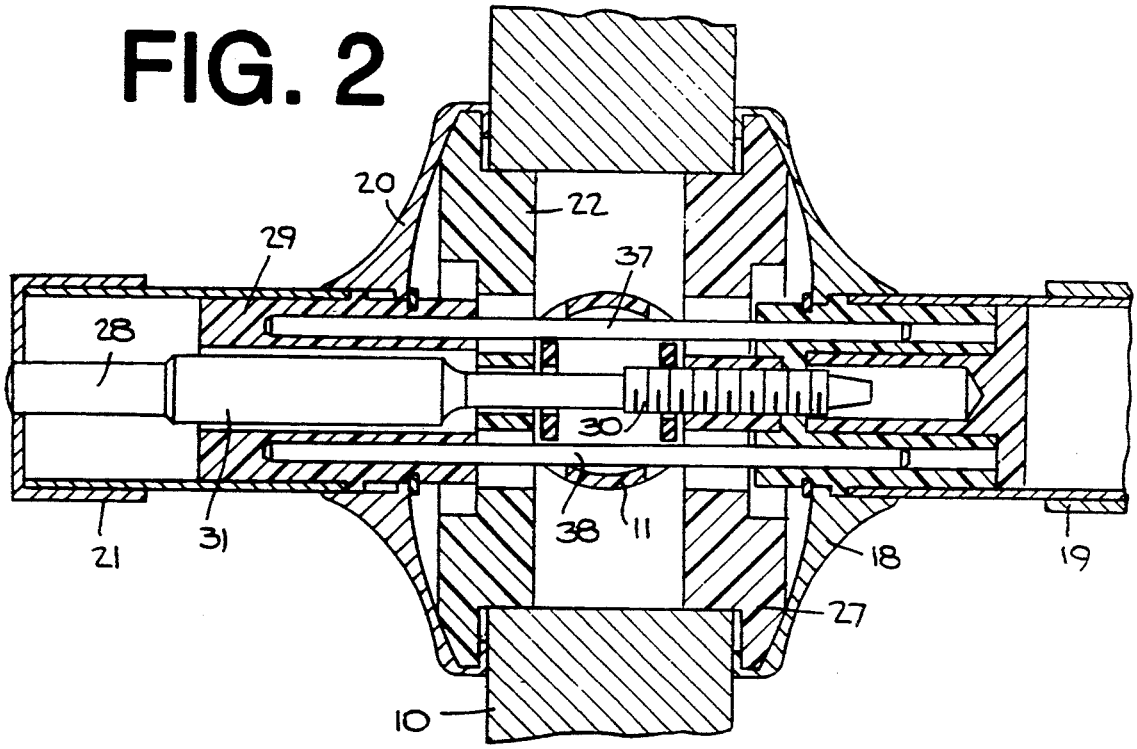
FIG. 2 shows the same door latch in its privacy mode.
Figure 3:
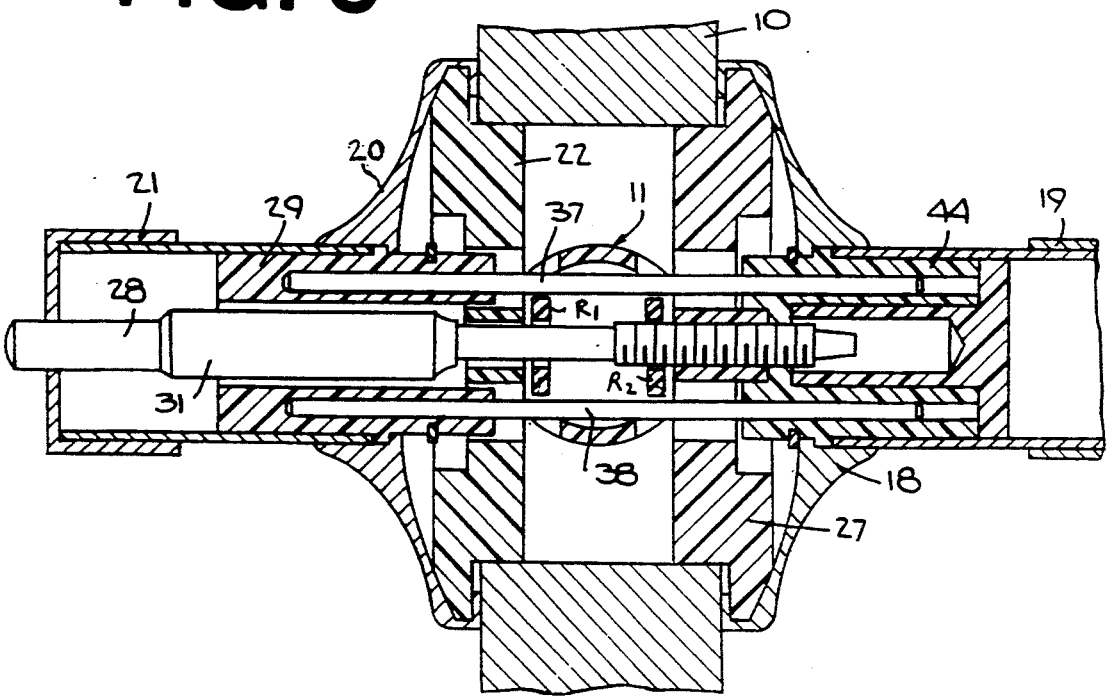
FIG. 3 is a section taken in the plane indicated by line 3 in FIG. 1.

Referring now to FIGS. 1, 2 and 3, a door latch in accordance with the invention is adapted to be installed in a hinged door 10 having a through opening therein adjacent its edge. Received in a bore in this edge, which is at right angles to the opening, is a latch bolt assembly, generally designated as 12, this assembly being conventional.

Assembly 12 includes a bolt 13 which is slidable within a casing and is biased by a helical spring 14 so that the bolt normally projects out of the front end of the casing into a strike plate 15 mounted over a cavity 16 formed n a door jamb 17, thereby latching the door in its closed state. In order to swing open the door, it must first be unlatched.

One end of the opening in door 10 is covered by a "free" escutcheon 18 having mounted thereon a knob 19 which is shown as being of the handle type. It is to be understood, however, that any other form of manually-turnable knob may be used. The opposite end of the door opening is covered by a "locking" escutcheon 20 on which is rotatably mounted a knob 21. The escutcheons may be stamped or otherwise formed out of corrosion resistant metal, such as steel, nickel or brass.

Nested within the circular base of locking escutcheon 20, which has a frusto-conical form, is a disc-shaped cap 22 molded of synthetic plastic material of high strength, such as polypropylene or polycarbonate. Integral with the outer face of cap 22 and projecting therefrom at diametrically opposed positions with respect to a center hole in the cap is a pair of hollow posts 23 and 24. The free ends of these posts are received in sockets 25 and 26 formed at corresponding positions in a disc-shaped plastic cap 27 nested in free escutcheon 18. Posts 23 and 24 serve as spacers, and their length is appropriate to the thickness of the door on which the escutcheons are mounted.

The escutcheons are secured to opposite sides of door 10 by a single rod 28 whose top end, as shown in FIGS. 1 and 3, when the door latch is in its latching mode, lies flush with a hole in knob 21 mounted on the locking escutcheon in alignment with the axis of rotation. A cruciform slot 28S in the top end is engageable by a Phillips screwdriver.

Rod 28 is inserted in a longitudinal bore in the short, cylindrical shaft 29 extending from knob 21, the shaft being rotatable in a central bearing in locking escutcheon 20. The threaded leading section 30 of the rod is threadably received in a center socket in cap 27 of the free escutcheon. The rod includes a section of enlarged diameter 31, which at its junction with a section of reduced diameter defines a shoulder 32 which rests on the inner surface of cap 22, so that the rod cannot be further screwed into cap 27. Thus, after the escutcheons are mounted on opposite ends of the door openings, all that is necessary to secure the escutcheons to the door is to screw in rod 28.

Figure 13:
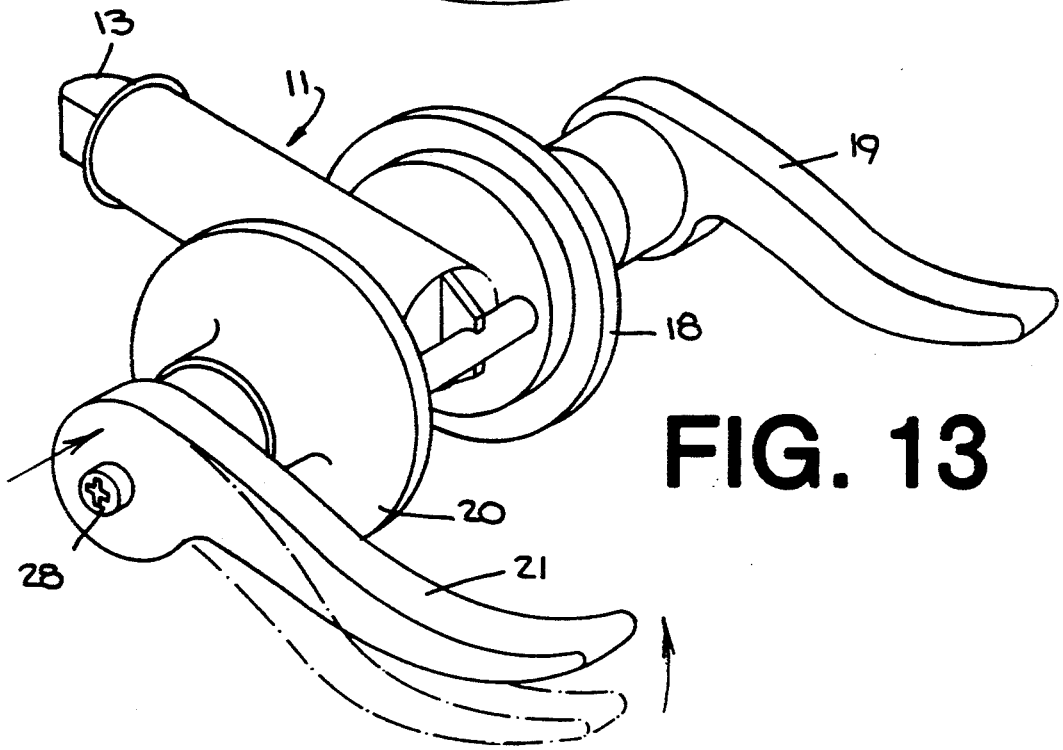
FIG. 13 shows the same latch in its privacy mode.

When knob 21 on the locking escutcheon is pushed in to put the door latch in its privacy mode so that the knobs cannot then be turned to unlatch the door, then the top end section of rod 28, as shown in FIGS. 2 and 13, protrudes from knob 21 to provide a visual indication that the door latch is in its privacy mode.

Figure 4:
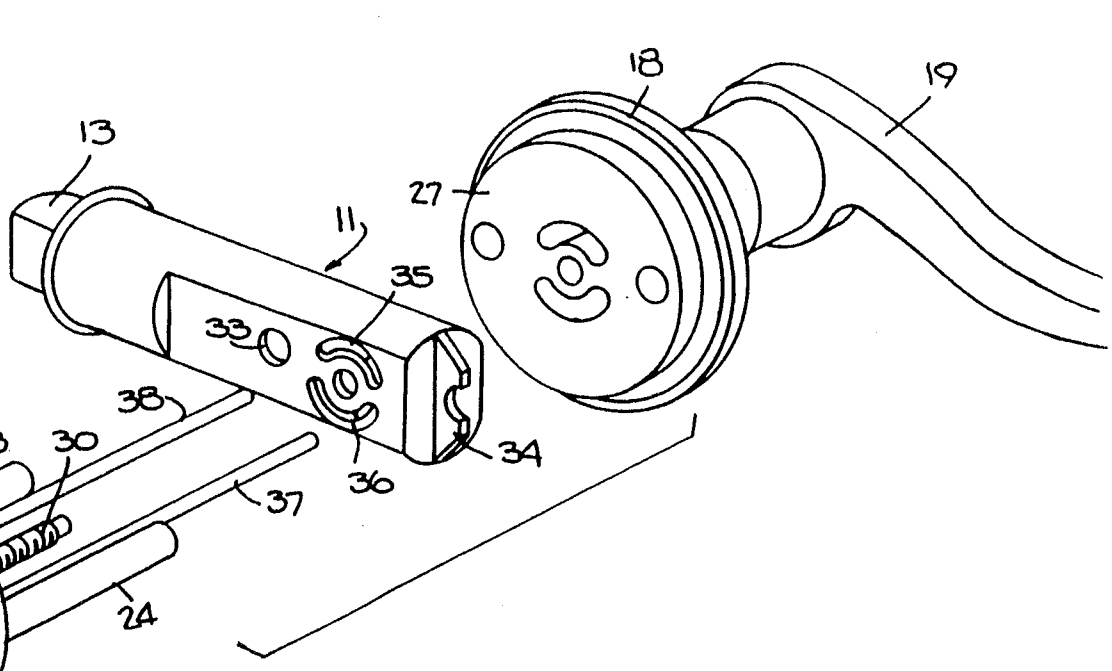
FIG. 4 is a section taken in the plane in FIG. 1, indicated by lines 4—4, showing the door latch in its latching mode.
Figure 5:
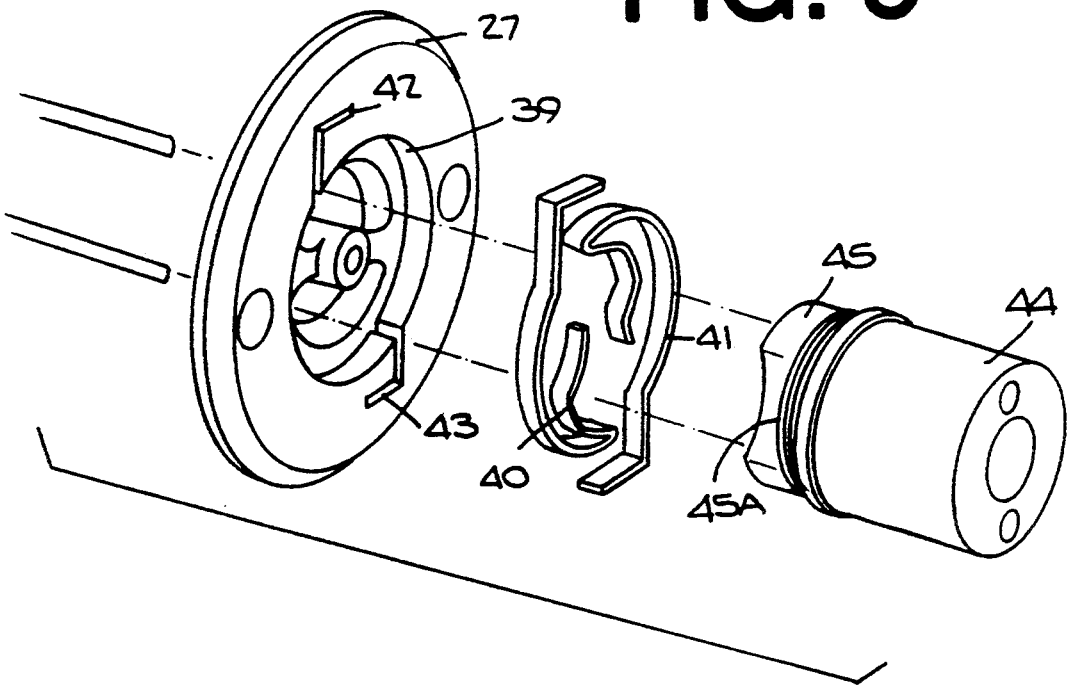
FIG. 5 is the same as FIG. 4, but in the privacy mode of the door latch.
Figure 9:
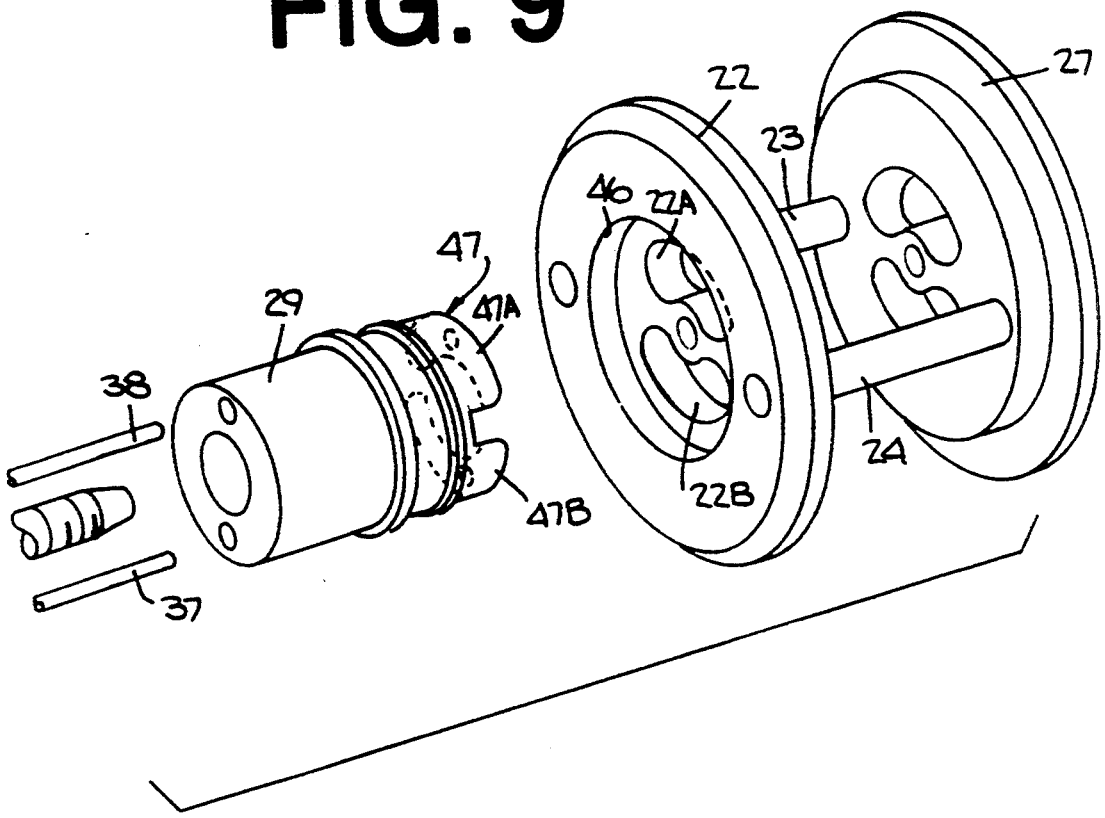
FIG. 9 is an end view showing the relationship of the split cam associated with the locking escutcheon when the knob on this escutcheon is at its rest position.
Figure 6:
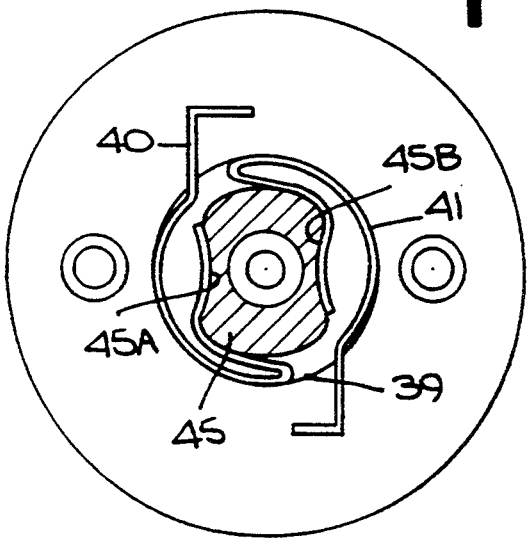
FIG. 6 is an exploded view of the components of the door latch.

As illustrated in FIGS. 4 to 6, latch bolt assembly 11 is held in place in the door opening between the escutcheons, this being effected by a lateral bore 33 at the midpoint of the casing and a notched lug 34 projecting from the far end of the assembly casing. Rod 28, which intercouples the escutcheons, passes through bore 33 in the assembly, the notched lug 34 engaging spacer post 34, as shown in FIG. 1, so that the assembly is properly oriented with respect to the escutcheons The casing of latch bolt assembly 11 is provided adjacent the far end of the casing with a pair of arcuate slots 35 and 36 in opposed relation to define a circle. These slots afford access to a pair of ramp elements mounted on parallel legs within the casing which are operatively coupled to the spring-biased bolt 13, the arrangement being such that when the ramps are pushed forward, the bolt is then retracted, as in a conventional latch bolt assembly.

A pair of pins 37 and 38 bridge shaft 29 of knob 21 mounted on the locking escutcheon and shaft 44 of knob 19 mounted on the free escutcheon. These pins are offset with respect to the common axis of rotation of these knobs. Pins 37 and 38 pass through arcuate slots 35 and 36 in the latch bolt assembly to engage a pair of ramps therein. When, therefore, either knob is turned clockwise or counterclockwise, the pins which bridge the shaft of the knobs travel in a circle concentric with the axis of rotation to engage and advance the ramp elements $R_1$ and $R_2$ within the assembly to cause bolt 13 to retract and compress spring 14. When the ramp elements return to their rest position, spring 14 is released to project the bolt into the strike plate.

Figure 8:
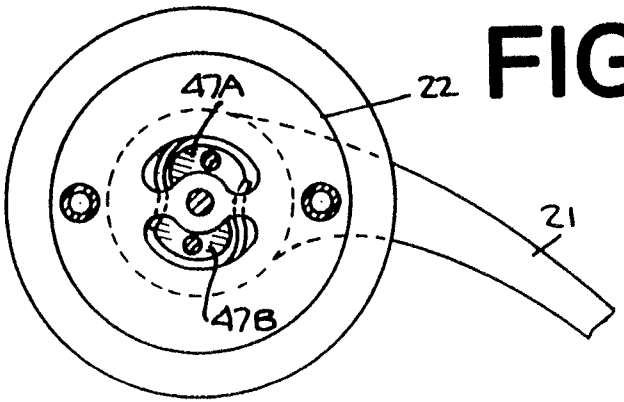
FIG. 8 is an end view showing the relationship of the shaped cam to the springs when the knob which turns the cam is at its rest position.
Figure 7:
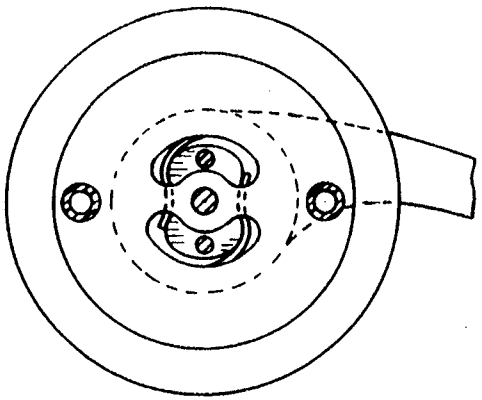
FIG. 7 is an exploded view showing the disc-shaped cap for the free escutcheon of the door latch, the springs to be nested in the cap, and the shaft of the knob mounted on this escutcheon whose shaped cam is to be engaged by the springs.

As shown in FIGS. 7 and 8, the disc-shaped plastic cap 27 seated within the circular base of free escutcheon 18 is provided on its inner face with a circular well 39 within which is housed a pair of flat springs 40 and 41 in opposing relation. Each spring is provided with an L-shaped foot that fits into corresponding L-shaped cuts 42 and 43 in the cap at the periphery of the well.

Each spring has a U-bend therein having a convex section at its free end.

Shaft 44 of knob 19 of free escutcheon 18 is provided at its end with a cam 45 having like concave indentations 45A and 45B on its opposing sides. The cam is seated between springs 40 and 41 in well 39 so that in the rest position of knob 19, the convex free end sections of springs 42 and 43 conform to the concave indentations of the cam to maintain the knob at its rest position. When the knob is turned in either direction, this action is resisted by the springs whose U-bends are then flexed.

When the knob is thereafter released, the flexed U-bends then seek to recover their original state, and in doing so return the knob to its rest position. In this way, the handle of the knob, which is horizontal in the rest position of the knob, after it has been turned in either direction to unlatch the door, will, when released, be returned to its horizontal position.

Figure 10:
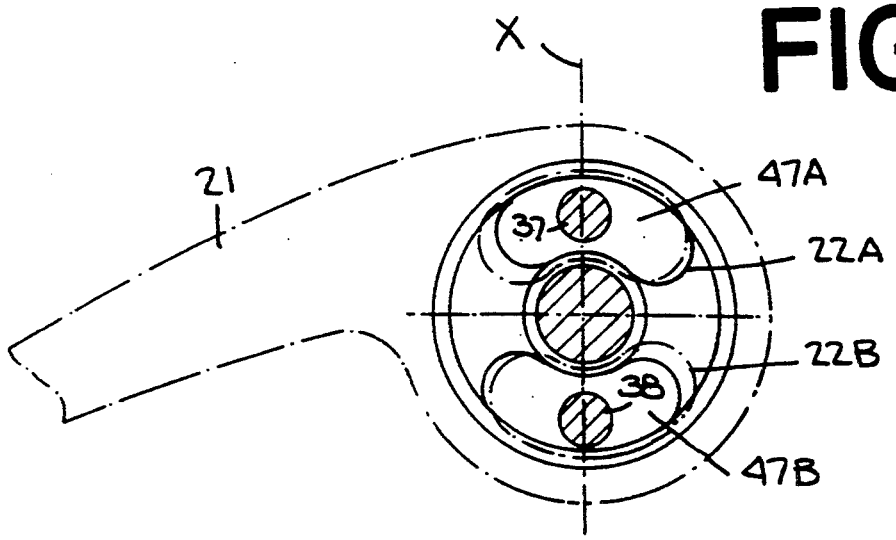
FIG. 10 is the same as FIG. 9, except that the knob has been turned clockwise.
Figure 11:
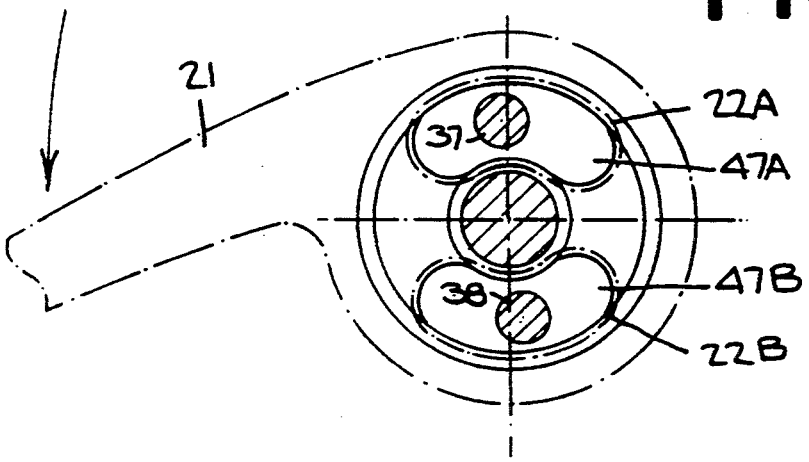
FIG. 11 is an exploded view showing the cap of the locking escutcheon joined by posts to the cap of the free escutcheon and the shaft for the knob on the locking escutcheon whose split cam is receivable in the privacy mode in arcuate slots in the locking escutcheon cap.

Referring now to FIGS. 10 and 11, it will be seen that cylindrical shaft 29 of knob 21 mounted in the locking escutcheon is provided at its free end with a split cam 47 defined by a pair of opposed kidney-shaped, arcuate sections 47A and 47B. These sections, which lie within a circle, are dimensioned to be received within a circular well 46 formed in the inner face of cap 22 seated within locking escutcheon 20. The base of well 46 is provided with a pair of arcuate slots 22A and 22B in opposed relation, whose shape and dimensions match those of sections 47A and 47B of the split cam.

When these cam sections are aligned with the arcuate slots and the shaft carrying the cam is pushed in to cause the cam sections to enter the slots, then the knob shaft is locked to the locking escutcheon, as shown in FIG. 2. The door latch is then in its privacy mode, the knobs cannot be turned and the door cannot be unlatched.

However, it is important that the knob on the locking escutcheon not be pushed in accidentally to put the door latch in its privacy mode unintentionally, as would happen if the knob were to strike a wall when the door is swung out.

Figure 12:
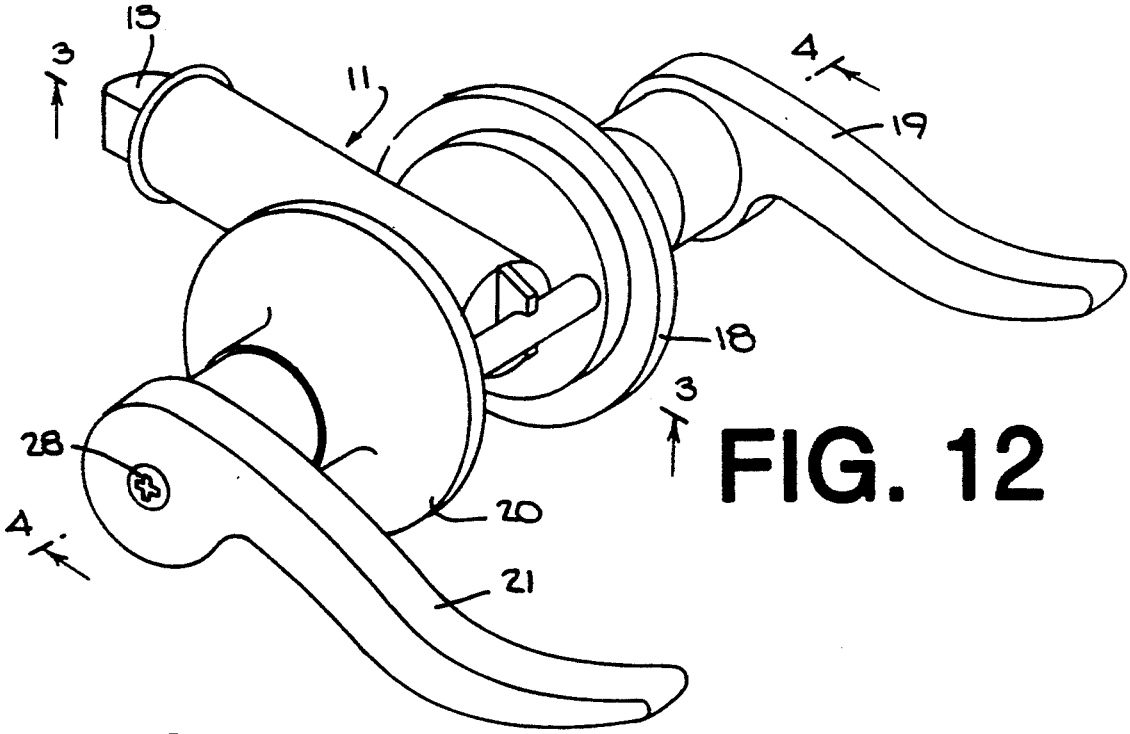
FIG. 12 is a perspective view of the door latch and it appears in its latching mode.

To this end, as shown in FIGS. 10 and 12, when the door latch is in its latching mode, and the knobs occupy a rest position at zero degrees, as indicated by vertical axis X, the arcuate sections 47A and 47B of split cam 47 are slightly displaced (about 5 degrees) from arcuate slots 22A and 22B in cap 22 of the locking escutcheon. Hence, it is not then possible to push in knob 21, for the cam sections will not then go into the slots. Hence, in order to push in the knob to put the door latch in its privacy mode, one must slightly turn the knob to bring the cam sections in registration with the slot, as shown in FIG. 13, and then push in the knob to insert the cam sections in the slots and thereby lock the mechanism, so that the knobs cannot be rotated until the knob on the locking escutcheon is pulled out to return the door latch to its latching mode.

The door latch is easy to install on a door, for all that is necessary is to insert the latch bolt assembly in the bore in the edge of the door, place the free escutcheon over the end of the opening on the outer side of the door and hold it there by,hand, while placing the locking escutcheon over the end of the opening on the inner side of the door, the pins projecting from the cap of the locking escutcheon being admitted into holes in the cap of the free escutcheon, and the posts projecting from the cap of the locking escutcheon being admitted into holes in the cap of the free escutcheon. Finally, the rod projecting from the cap of the locking escutcheon is screwed into a socket in the cap of the free escutcheon.

While there has been shown and described a preferred embodiment of a two-way door latch in accordance with the invention, it will be appreciated that many changes and modification may be made therein without, however, departing from the essential spirit thereof.

I claim:

1. A two-way door latch for a door swingable with respect to a door jamb, the door having an opening adjacent its edge and a bore in the edge in alignment with a strike plate mounted over a cavity in the door jamb, said door latch comprising:

(a) a latch bolt assembly received in the bore, said assembly being provided with a spring-biased bolt that normally projects into the strike plate, and a pair of ramp elements operatively coupled to the bolt to cause the bolt to retract when the ramp elements are engaged by pins;

(b) a first escutcheon mounted over one end of the door opening and having a first knob rotatably mounted therein, said knob having a short shaft extending into the escutcheon and terminating in a cam;

(c) a second escutcheon mounted over the opposite end of the door opening and having a second knob rotatably mounted therein, said second knob having a short shaft extending into the second escutcheon and terminating in a cam, the shaft of the first and second knobs rotating about a common axis; the shaft of the second knob being axially displaceable with respect to the second escutcheon, and when pushed in, is then locked to the escutcheon to prevent rotation whereby the door latches in a privacy mode, said second escutcheon having a circular base in which is nested a cap having a well in which is received the cam on the shaft of the second knob, the well having a base provided with a slot whose shape conforms to that of the cam, whereby when the second knob is pushed in, the cam is then received in the slot to lock the shaft to the second escutcheon;

(d) a pair of pins bridging the cams of the first and second knob shafts and offset with respect to said axis, whereby when the knobs are turned in either direction, the pins then travel in a circular path concentric with the axis, said pins engaging the ramp elements to retract the bolt; and (e) spring means disposed within the first escutcheon to engage the cam therein, said cam being shaped in relation to the spring means to maintain the related knob at a rest position and to return the knob to the rest position after the knob has been turned to retract the bolt and then released, the cam in the first escutcheon having concaved indentations on opposing sides thereof and said spring means having convexed sections therein which engage and conform to said indentations when the knob is at said rest position.

2. A door latch as set forth in claim 1, in which said first escutcheon has a circular base in which is nested a plastic cap having a circular well in which is received the cam, said spring means being housed in said well.

3. A door latch as set forth in claim 1, in which at the rest position, the cam is a few degrees out of registration with the slot, and in order to push in the second knob, it must be turned to bring the cam in registration with the slot.

4. A door latch as set forth in claim 1, in which the first escutcheon is joined to the second escutcheon by a single rod whose top end is flush with a hole in the second knob, so that when the second knob is pushed in, the end of the rod then projects from the second knob to provide a visual indication that the door latch is in a privacy mode.

* * * * *